US006251477B1

(12) United States Patent
Kinnunen et al.

(10) Patent No.: US 6,251,477 B1
(45) Date of Patent: Jun. 26, 2001

(54) PAPER COATING APPARATUS AND METHOD FOR COATING PAPER

(75) Inventors: Jorma Kinnunen, Järvenpää ; Vilho Nissinen, Numminen, both of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/355,212

(22) PCT Filed: Jan. 27, 1998

(86) PCT No.: PCT/FI98/00082

§ 371 Date: Aug. 4, 1999

§ 102(e) Date: Aug. 4, 1999

(87) PCT Pub. No.: WO98/32921

PCT Pub. Date: Jul. 30, 1998

(30) Foreign Application Priority Data

Jan. 27, 1997 (FI) ..... 970340

(51) Int. Cl.[7] ..... B05D 1/40; B05C 1/08; D21F 5/00; B65H 20/00

(52) U.S. Cl. ..... 427/209; 427/211; 427/361; 427/372.2; 427/428; 118/62; 118/65; 118/67; 162/340; 226/97.1; 226/97.2; 226/97.3

(58) Field of Search ..... 427/209, 211, 427/361, 372.2, 428; 118/58, 62, 65, 67; 162/340; 226/97.1, 97.2, 97.3

(56) References Cited

U.S. PATENT DOCUMENTS 5,230,165 7/1993 Beisswanger .
5,496,406 3/1996 Beisswanger et al. .
5,639,303 * 6/1997 Plomer ..... 118/218

FOREIGN PATENT DOCUMENTS 44 16 399 A1 11/1995 (DE) .
WO 95/30795 11/1995 (WO) .
WO95/30049 * 11/1995 (WO) ..... D21H/23/70

* cited by examiner

*Primary Examiner*—Shrive Beck
*Assistant Examiner*—Jennifer Kolb
(74) *Attorney, Agent, or Firm*—Cohen, Pontani, Lieberman & Pavane

(57) ABSTRACT

Apparatus and method for coating a moving paper web, in which the web (2) to be coated is first guided to a coating station (7) correctly aligned and a first side of the web (2) is coated with a coat layer. Next, the web (2) is guided upwards from the coating station (7) and the first coat layer is dried using non-contact dryers (8, 9). From the dryers the web (2) is guided to the next coating station (14) correctly aligned, and the second side of the web (2) is coated with a coat layer, the web (2) is guided upwards from the coating station (14) and the coat layer on the second side of the web (2) is dried using non-contact dryers (8, 9). When the web is directed from the coating station (7) through the dryers (8, 9), it (2) is guided non-contactingly by means of air jets such that the web (2) is first non-contactingly turned in the machine direction during drying and next, similarly during drying, towards the level of the coating stations (7, 14).

32 Claims, 3 Drawing Sheets

PAPER COATING APPARATUS AND METHOD FOR COATING PAPER

FIELD OF THE INVENTION

The present invention relates to an apparatus and method for coating a moving paper web.

BACKGROUND OF THE INVENTION

In paper coating, a coating layer is applied onto a base paper web manufactured on a paper machine, and then the coating is doctored to a target thickness. The coating is a mixture of water and solids, and accordingly, the web must be dried before it can be taken to subsequent treatment steps. Various kinds of dryers are known and they can be divided into, e.g., non-contact dryers and contact dryers. Dryers which touch the web comprise different kinds of heated cylinders, and non-contact dryers include, among others, infrared dryers and suspending air dryers. In drying cylinder groups, the web is pressed against heated cylinders by means of a wire or by means of underpressure generated inside the cylinder, whereby the web is dried due to the effect of contact heat. Infrared dryers, then, are placed in the vicinity of the web which travels guided by rolls, and the heat energy is transmitted to the web by means of radiation. In suspending air dryers, hot air is blasted towards the web, whereby the air not only has a drying but also a supporting and guiding effect on the web.

After the application of the coating, the drying of the web must be effected without touching the web because the wet web will not endure mechanical contact. Usually, both infrared and suspending dryers or combinations thereof are used for initial drying. Cylinder drying can be used first when the coat has become semi-solid and no longer adheres to the cylinders. The cylinders are used to impose the required draw on the web.

Off-machine coating apparatuses are used to treat base paper which is manufactured on a paper machine and taken to the coating stage in rolls. The apparatus comprises an unwinder, at least one coater for each side of the web, drying means arranged after the coaters, and a reeler for reeling in the coated paper. Such a coating apparatus is quite long and complex. Particularly the length of the apparatus is a disadvantage because the increased length considerably increases the space required by the machine in a factory. Most of the length of the arrangement is taken up by drying units and guide rolls needed for guiding the web and for redirecting it.

Because a coated web can only be supported on the uncoated side of the web prior to the solidification of the coating, it is necessary to bring the web through the non-contact dryers after coating supported only on one of its sides. Therefore the web must, after it has left the coater, be formed into an open loop, the coater backing roll remaining inside the loop, so that the web can be stretched and supported in the dryer area into a loop formed by the backing roll and the guide rolls. At the other end of the loop either a group of drawing-in rolls or a creasing roll is provided which turns the web support to the coated side. The web must also be brought to the coater aligned in a certain direction because modern coaters are designed such that coat metering usually takes place below the center line of the backing roll. As a result of this, the web has to travel in a double loop at least after the second coater because the web must be guided to the dryers such that it turns into its incoming direction, and after the dryers the web must then be turned back into the travel direction of the coater apparatus. If the drawing-in group of the apparatus comprises a group of drying cylinders, it is usually necessary to take the web via the group of drying cylinders after one of the coating and drying stages, whereby it travels backwards on the cylinders in the direction of the coating apparatus. As a result, a great number of rolls is needed to support the web and the entire apparatus is very long because bringing the web via the non-contacting dryers and the group of drying cylinders requires a lot of space in the long direction of the apparatus.

German patent document describes a coating apparatus where an arrangement of the dryers has been aimed at allowing the same manner of drying on both sides of the web. A reduced length of the apparatus has been sought by arranging the web to travel in loops on top of one another whereby a considerable number of guide rolls is required for guiding the web, particularly over the section for drying the second side of the web. The length of the apparatus is not essentially reduced compared to other coaters; instead the complex travel of the web can only be used to reduce the increase in the length of the apparatus which is due to the complex drying section.

In the apparatus disclosed in PCT Application No. WO 95/30049, the travel of the web is slightly simplified after the second coater by means of an air-turning device. In this solution, the web is turned onto its coated side prior to drying round the air-turning device, whereby, after the turning gear, the web can be guided directly to the non-contacting dryer, and a straighter travel of the web is achieved. However, the length of this apparatus is also considerable, and for web guiding, several guide rolls are required. Even here, the structure of the film transfer coaters determines the incoming angle as well as the angle of departure of the web, and the travel of the web must be arranged accordingly.

European Patent Application No. 93112695 describes a coating apparatus wherein the coat is applied onto the web surface by means of a film transfer roll. The film transfer roll and its backing roll are arranged on top of one another or essentially on top of one another and the web departs in a horizontal or an essentially horizontal position. After the coaters the web is guided by means of one or several air beams such that its direction is altered. In practice, the web is turned downwards at a low-gradient angle. After turning, the web is dried using a non-contacting dryer and drying cylinders. This solution achieves reasonably good runnability because after coating the web is guided non-contactingly, but if several non-contacting dryers are required for obtaining sufficient drying capacity, a very long machine results. The air beams can only be used to provide very gentle turning, so that the dryers after the turning must be positioned essentially in the direction of the web. Thus, in practice, the apparatus must be constructed at one level only, and the web can not be guided to travel in elevation in order to shorten the structure. Hence, the aim of the present invention is to create certain kind of conditions for drying after the film transfer coater.

SUMMARY OF THE INVENTION

The present invention aims at achieving a coating apparatus arrangement which is shorter than known coater apparatuses and in which the travel of the web is implemented following as simple a path as possible.

The invention is based on turning the web forward in the travel direction after each coating step and on guiding the web via air-turning devices and suspending air dryers directly to the drawing-in group.

The invention offers considerable benefits.

By the arrangement lay-out of the invention a clearer and more compact coating machine construction is achieved than that of the prior-art apparatuses. Compared to a typical modern apparatus, the space required is reduced by approximately one third. As a reference example, a two-layer coating apparatus may be cited having four coating stations. The length of such an apparatus is approximately 90 m and its height is 12.5 m, but the invention will provide an arrangement having a length of 60 m and a height of 9.5 m. This is of considerable advantage in the design of the factory lay-out and especially when the arrangement is placed in existing facilities. The number of guide rolls and drying cylinders can be considerably reduced, that is, from 130 in the reference apparatus to 80. Furthermore, all guide rolls can be arranged in the lower part of the apparatus whereby there are no rotating parts in the upper part. Thus, a simpler and lighter frame construction is obtained in the arrangement. The number of maintenance bridges in the upper part of the machine can also be reduced.

If desired, the drying of coated paper can be performed entirely by means of non-contacting dryers whereby no drying cylinders of great diameter are required. Hot air can be used in the turning devices, thus increasing the drying capacity. The increase in drying capacity depends on what air flow rate can be used for the turning devices. If no drying cylinder group or wire-furnished group of drawing rolls is used after the suspending air dryers, an even shorter arrangement is obtained and a greater number of alternative constructions is provided. Non-contacting web guiding stresses the wet web less than guiding implemented by means of rolls, which provides improved runnability. A further advantage of the invention is that with air-supported travel of low friction, web tension is easier to control.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

In the following description the forward end of the machine is the end on the side of the unwinder and the end on the side of the reeler is its terminal end. The expression Aforward in machine direction denotes transfer towards the terminal end. The lower part of the machine is the level of the coaters and the level above this level is the upper part of the machine.

Figure 1:
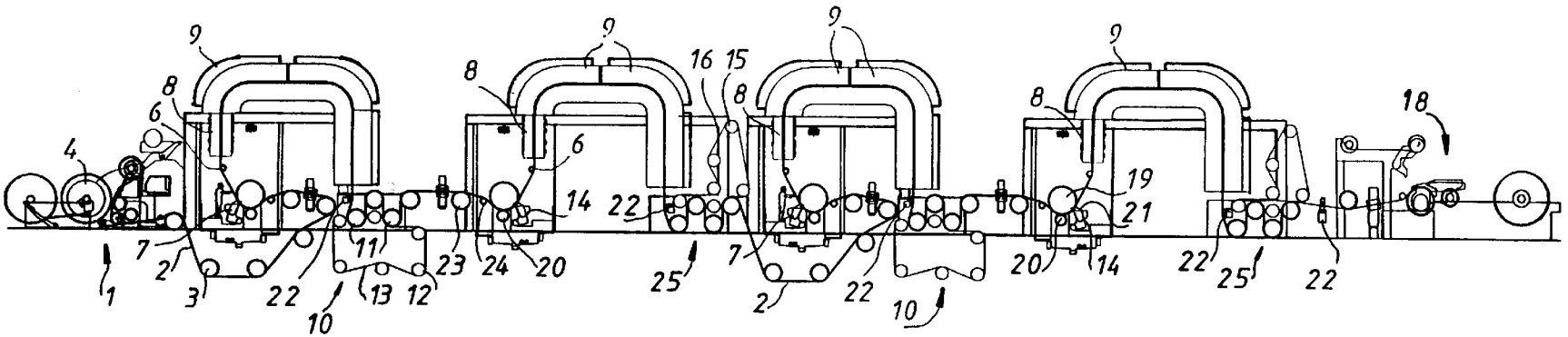
FIG. 1 is a side view of an apparatus according to the invention.

FIG. 1 depicts a coating machine or a coating apparatus with four coating stations 7, 14. This apparatus can thus be used to coat both sides of the paper twice. The illustrated apparatus is an off-machine coater, and thus, an unwinder 1 is first provided at the forward end of the machine for feeding rolls 4 from the paper machine to the coating machine. From the unwinder 1 the paper web 2 which has been wound off the rolls 4 is guided to a first coating station 7 via guide rolls 3, the coated web 2 travelling further to dryers 8, 9 from the coating station. The coating station 7 may comprise e.g. a short-dwell coater, a film transfer coater or another suitable coater, or, as in the present example, an applicator roll coater in combination with coating knife doctoring. The coat metering device, in this case the applicator roll 20, is always below the backing roll 19 and the doctor means 21 is arranged after the applicator roll 20 and operates against the same backing roll 19. The web 2 to be coated must be taken to the coating station at a certain angle and the angle of departure of the web 2 is also a given one. The first coating station 7 is turned against the machine direction and the web 2 is guided via guide rolls 3 to travel in a loop under the first coating station 7. In this manner the length of the machine can be reduced because the dryers 8, 9 can be arranged above the coating station.

From the coating station 7 the web is guided via a guide roll 6 to the dryers 8, 9. As the guide roll 6, a spreader roll is advantageously used because the web swells when wetted. The dryers are fitted to form a U-shaped loop and the first fork of the letter is constituted by an infrared dryer 8 having four lines of emitters which can optionally be switched on when needed. The infrared dryer is in an upright position and after it in the travel direction of the web a turning device is provided which is connected to a suspending air dryer 9. The suspending dryer is in a horizontal position and after it the web is guided via the turning device to a vertical second suspending dryer. As the turning device and the suspending dryer, means described below comprising a suspending dryer and a turning device are advantageously used.

From the dryers 8, 9 the web 2 is guided almost directly to the drawing-in group 10 via the spreader roll 22. The web 2 must be bent slightly over the spreader roll 22 in order to ensure the contact between the web and the roll. The drawing-in group 10 is a drawing-in group furnished with a wire and consisting of drawing-in rolls 11, a wire 13 and wire-guiding rolls 12. There are four drawing-in rolls 11 and they are arranged in two rows on top of one another. A first wire-guiding roll is arranged in front of the first drawing-in roll and a second one between the first and third drawing-in rolls beneath the second drawing-in roll. The web 2 travels round the drawing-in rolls 11 and the wire 13 round its guiding rolls such that the wire 13 is pressed against the first and the third drawing-in roll whereby the web 2 is pressed between the drawing-in roll and the wire. The purpose of the drawing-in group is to provide sufficient web 2 tightness between the coating station and the drawing-in group such that the web can be supported by means of suspending dryers and air-turning devices.

From the drawing-in group 10 the web 2 is guided to the next coating station 14 which incidentally is identical to the first coating station 7 but has a forward position in the machine direction. Now the web 2 can be taken directly to the backing roll 19 directly via the guiding rolls 23, 24 of the coating station 14. From the coating station 14 the web is directed upwards to dryers 8, 9 and from there further to the group 10 of drawing-in rolls. The web 2 now departs from the coating station 14 in machine direction and is turned to the dryers 8, 9 via the guiding roll 6. The dryers 8, 9 are directed in the machine direction like the dryers at the first coating station 7, wherefore the web 2 has to be turned by means of the turning device of the dryers 9 onto the damp coated side of the web. This can be implemented by air turning devices without jeopardizing the quality of the coat. The construction of the actual dryer arrangement is similar to that of the previous dryers and from the dryers the web is guided directly to the group 25 of drawing-in rolls. The group 25 of drawing-in rolls is similar to the first group of drawing-in rolls in other respects but here the wire 16 and the wire-guide rolls 15 are arranged above the drawing-in rolls 11. In this manner the coated side of the web can be guided backed by rolls 11 over the wire-supported section.

From the second group 25 of drawing-in rolls the web 2 departs in a manner corresponding to its departure from the unwinder 1 and is then guided to a second coating step where a second coat layer is applied onto both sides of the web. The second coating step is similar to the first one and after the second step the web 2 is guided to the reeler 18. Because the width of the web is altered during coating due to the changes in its dampness, the web must be spread using spreader rolls 22 or, alternatively, cambered turning means. The spreader rolls 22 or the spreading turning means are to be fitted at least between each dryer and drawing-in group and before the reeler 18.

Figure 2:
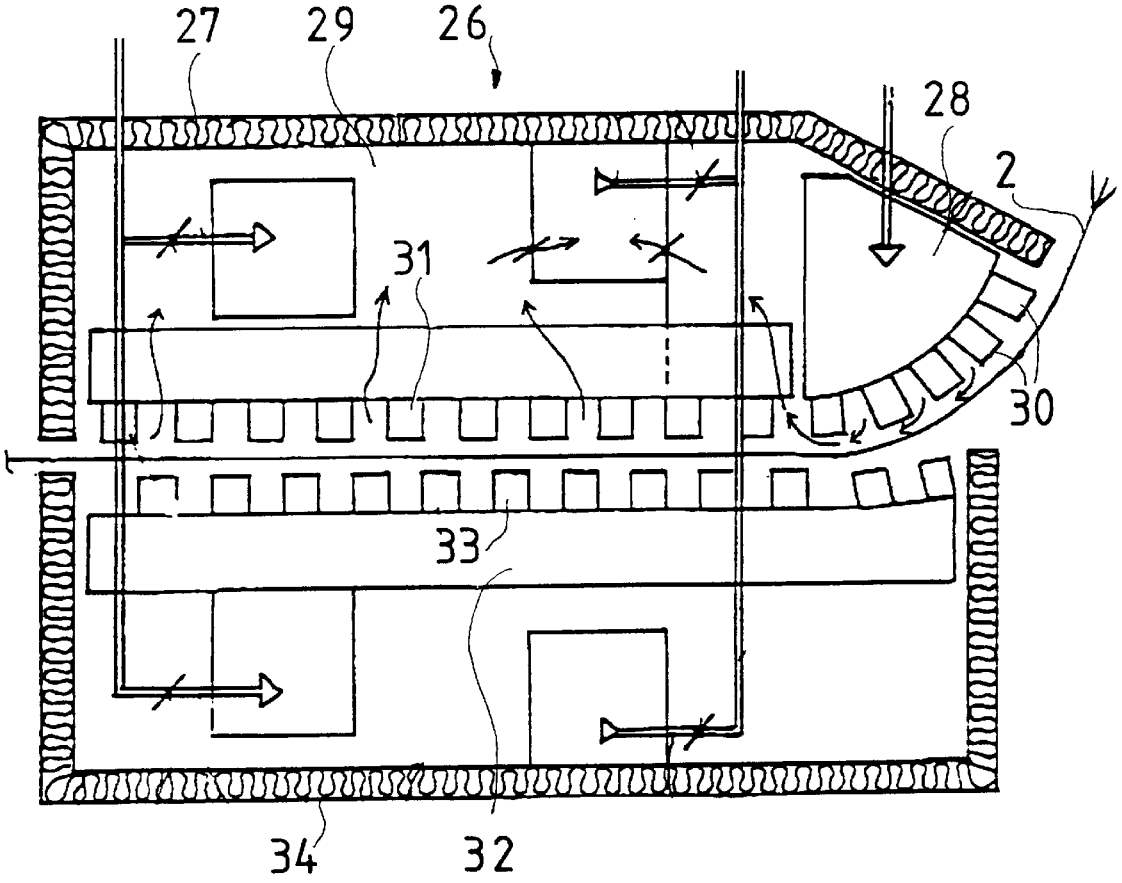
FIG. 2 is a schematic representation of a combination of a turning device and a suspending dryer.

As the suspending air dryers, turning device dryers according to FIG. 2 are advantageously used wherein the turning device is arranged in a shared housing with the dryer on the same side of the web and both devices share the same air exhaust devices. In the apparatus of FIG. 2 a complex 26 of apparatuses is situated beneath the paper web 2, with a housing 27 incorporating a turning device 28 and a dryer 29 essentially immediately after said turning device. The turning device 28 comprises nozzles 30 providing an air blast for turning the web 2 non-contactingly. The dryer 29 comprises nozzles 31 through which air is blasted in order to dry the web 2. Between the nozzles 31, the dryers 29 have discharge outlets through which humid air is removed from the space between the web 2 and the dryers 30. Air supplied by the turning device 28 is also removed from the dryer 29 nozzle section, preferably through the discharge outlets at the forward end. Dryer means 32 are provided above the web 2 having nozzles 33 and discharge orifices between the nozzles for removing humid air. Hot air is blasted through the nozzles for drying the coat on the web 2 and also the lower dryer is encased inside a housing 34. The dryer 32 on top extends into the area of the lower dryer 29 and both partially and totally also into the area of the turning means 28. In FIG. 1 the dryers are encased as integral units over the entire drying length, wherefore the housing structure is slightly different from the solution in FIG. 2. The encapsulation can be carried out in many ways but the advantage provided by the shared housing of FIG. 1 lies in the better energy efficiency achieved and in that the access of drying air into the factory building is more efficiently prevented. In addition, a simpler and clearer dryer construction is provided. In the above-described layout, implementation the entire section with air dryers can be constructed as a continuous system or it can be assembled from units of the above-described type in a suitable successive sequence. The solution of FIG. 1 shows two dryers arranged one after the other and having turning devices at their forward end.

As the turning and drying means in the above-described apparatus are arranged under a shared housing, elevated air temperature can be applied in the turning means. The air temperature of the turning device is advantageously 80 to 300° C., preferably 100 to 200° C. As the air discharged from the turning means is removed by suction and returned to the air system, a great amount of air at an elevated temperature can be removed from the area in a controlled manner without risking the runnability. The air temperature at the actual drying section may be as high as 450° C. and the air flow rate may reach 100 m/s. In the embodiment of FIG. 1, preferred air temperatures and flow rates at the turning means are 80° C. and 45 m/s and at the dryer 180° C. and 55 m/s.

The above-described combination of a turning means and a dryer is described in Finnish Patent Application No. 955085, the various embodiments and construction of the arrangement emerging in more detail from said document. As such, the use of different kinds of turning means and dryers is well known in the field of paper manufacture and does not require further clarification in the present context. In the arrangement according to the invention, however, a drying two-sided turning device is preferably used with a turning air temperature which exceeds the temperature in the factory building.

Figure 3:
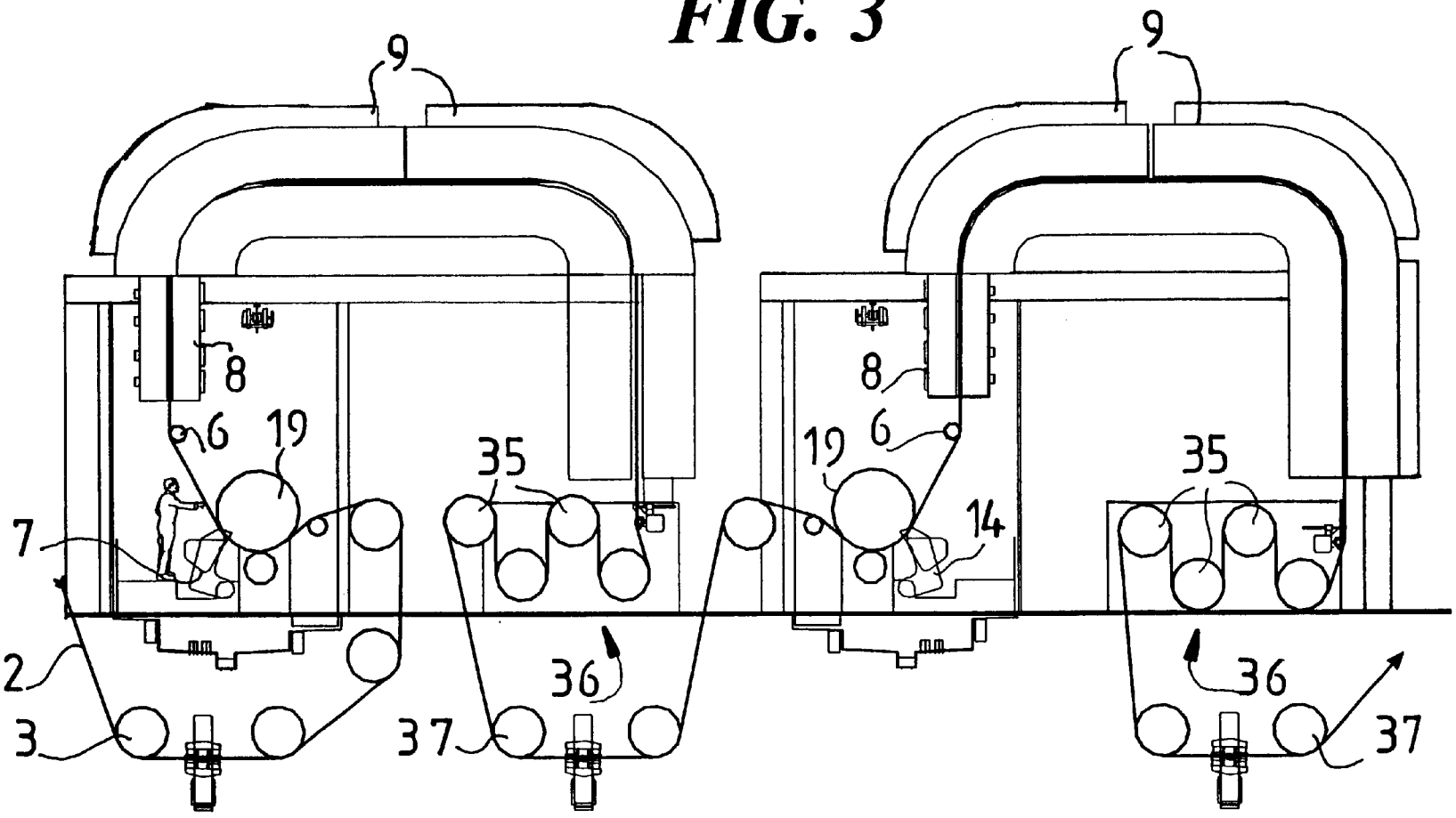
FIG. 3 provides a side view of a second arrangement according to the invention.

An embodiment is shown in FIG. 3 providing an even shorter arrangement. The coaters 7, 14 themselves with the non-contacting dryers 8, 9 are arranged as in the arrangement of FIG. 1 but here the dryers 8, 9 are not followed by a wire-furnished group of drawing-in rolls but instead by a group 36 of drawing-in rolls where the necessary friction is effected directly between the rolls 35 and the web 2. The group 36 of drawing-in rolls is turned backwards in the machine direction such that the web 2 turns on the rolls 35 under the non-contacting dryers 8, 9. From the drawing-in rolls 35 the web 2 is turned back into the machine direction by means of guide rolls 37. In this manner a very short arrangement is obtained and the embodiment is advantageous in implementations where a wireless drawing-in roll group can be used.

In addition to the above, the present invention has other embodiments as well.

It is not necessary to arrange the turning devices and the suspending air dryers in the same housing but if the turning devices are separated from the dryers, a sufficient distance between them must be provided, and hot air can not necessarily be used in the turning device. Separate devices also require more space, resulting in increased coater length. As explained above, the length of the apparatus can be reduced by turning the drawing-in group at each coating stage backwards in the machine direction. The drawing-in group can be implemented in many ways. If additional drying is required after the non-contacting dryers, a group of drying cylinders can be used as the drawing-in group. An alternative to this is a simplified cylinder group where the cylinders over which the wire does not travel have been replaced by rolls. Part of the rolls in the drawing-in roll group may comprise sector suction rolls arranged on the dry side on the paper, whereby no wire is needed. At low speeds, grooved rolls are sufficient as the drawing-in group but they must hereby be furnished with impression rollers for web feeding. If the drawing-in roll group is implemented without a wire, more alternatives are available in the layout design of the machine.

Naturally, it is also possible to attach a calender to the coating machine prior to the reeler. As coating stations, known coating stations may be used, and the structure of the coating station has no direct impact on the application of the invention. The number of stations is determined by the coat layers. Usually, off-machine apparatuses of the above-described kind are used to manufacture duplex-coated paper but the invention can also be applied to single- or triple-layer coating. The machine of the invention can naturally also be used as an on-machine apparatus provided in connection with a paper machine.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for coating a moving paper web, comprising:

a first coating station where a first side of the web is coated with a coat layer;

a first guide means for guiding the web to said first coating station;

a first non-contact dryer downstream of and above the first coating station for drying the coat layer applied to the web in said first coating station without contacting the web, said first non-contact dryer comprising a first air dryer;

a second guide means for guiding the web from said first coating station upwards into said first non-contact dryer;

a first means for pulling the web from said first coating station through said first non-contact dryer, said first means for pulling the web from said first coating station through said first non-contact driver comprises a first group of drawing-in rolls furnished with a wire;

a first non-contacting guide means for guiding the web within and through said first non-contact dryer so that the web is first guided upward, then substantially horizontally in a machine direction, and then downward, said first non-contacting guide means comprising air jets;

a second coating station where a second side of the web is coated with a coat layer, said second coating station being downstream of said first non-contact dryer;

a third guide means for guiding the web to said second coating station;

a second non-contact dryer downstream of and above said second coating station for drying the coat layer applied to the web in said second coating station without contacting the web, said second non-contact dryer comprising a second air dryer;

a fourth guide means for guiding the web from said second coating station upwards into said second non-contact dryer;

a second means for pulling the web from said second coating station through said second non-contact dryer; and a second non-contacting guide means for guiding the web within and through said second non-contact dryer so that the web is first guided upward, then substantially horizontally in a machine direction, and then downward, said second non-contacting guide means comprising air jets.

2. The apparatus of claim 1, wherein said second and fourth guide means comprises a roll.

3. The apparatus of claim 2, further comprising a first spreader roll positioned downstream of said first non-contact dryer and a second spreader roll positioned downstream of said second non-contact dryer.

4. The apparatus of claim 2, further comprising a first cambered air turning device positioned downstream of said first non-contact dryer and a second cambered air turning device positioned downstream of said second non-contact dryer.

5. The apparatus of claim 2, wherein the roll of said second and fourth guide means is a spreader roll.

6. The apparatus of claim 1, wherein said second means for pulling the web from said second coating station through said second non-contact dryer comprises a second group of drawing-in rolls furnished with a wire.

7. The apparatus of claim 1, further comprising:

a third coating station where the first side of the web is coated with a coat layer, the third coating station being downstream of said second non-contact dryer;

a fifth guide means for guiding the web to said third coating station;

a third non-contact dryer downstream of and above the third coating station for drying the coat layer applied to the web in said third coating station without contacting the web, said third non-contact dryer comprising a third air dryer;

a sixth guide means for guiding the web from said third coating station upwards into said third non-contact dryer;

a third means for pulling the web from said third coating station through said third non-contact dryer;

a third non-contacting guide means for guiding the web within and through said third non-contact dryer so that the web is first guided upward, then substantially horizontally in a machine direction, and then downward, said third non-contacting guide means comprising air jets;

fourth coating station where the second side of the web is coated with a coat layer, said fourth coating station being downstream of said third non-contact dryer;

a fourth non-contact dryer downstream of and above said fourth coating station for drying the coat layer applied to the web in said fourth coating station without contacting the web, said fourth non-contact dryer comprising a fourth air dryer;

a eighth guide means for guiding the web from said fourth coating station upwards into said fourth non-contact dryer;

a fourth means for pulling the web from said fourth coating station through said fourth non-contact dryer; and a fourth non-contacting guide means for guiding the web within and through said fourth non-contact dryer so that the web is first guided upward, then substantially horizontally in a machine direction, and then downward, said fourth non-contacting guide means comprising air jets.

8. The apparatus of claim 1, wherein said non-contact dryers comprise a suspending air dryer and a turning means for supporting the web during turning using drying air jets.

9. The apparatus of claim 8, wherein said non-contact dryers comprise a turning means for non-contactingly turning a direction of travel of the web, and wherein said turning means and said first and second air dryers comprise nozzles for effecting a blast of air and an exhaust device for removing exhaust air proximate the web, said turning means and said respective air dryers being positioned adjacent a same side of the web.

10. The apparatus of claim 9, wherein said turning means of said first non-contact dryer, said first air dryer and said exhaust device of said first non-contact dryer are positioned within a shared first housing, and said turning means of said second non-contact dryer, said second air dryer and said exhaust device of said second non-contact dryer are positioned within a shared second housing.

11. The apparatus of claim 8, wherein a temperature of air emitted by said air jets of said turning means is greater than an ambient temperature.

12. The apparatus of claim 11, wherein the temperature of air emitted by said air jets of said turning means is from 80° C. to 300° C.

13. The apparatus of claim 12, wherein the temperature of air emitted by said air jets of said turning means is from 100° C. to 200° C.

14. The apparatus of claim 1, wherein a temperature of air emitted by said air jets of said non-contacting guide means is greater than an ambient temperature.

15. The apparatus of claim 14, wherein the temperature of air emitted by said air jets of said non-contacting guide means is from 80° C. to 300° C.

16. The apparatus of claim 15, wherein the temperature of air emitted by said air jets of said non-contacting guide means is from 100° C. to 200° C.

17. An apparatus for coating a moving paper web, comprising:

a first coating station where a first side of the web is coated with a coat layer;

a first guide means for guiding the web to said first coating station;

a first non-contact dryer downstream of and above the first coating station for drying the coat layer applied to the web in said first coating station without contacting the web, said first non-contact dryer comprising a first air dryer;

a second guide means for guiding the web from said first coating station upwards into said first non-contact dryer;

a first means for pulling the web from said first coating station through said first non-contact dryer;

a first non-contacting guide means for guiding the web within and through said first non-contact dryer so that the web is first guided upward, then substantially horizontally in a machine direction, and then downward, said first non-contacting guide means comprising air jets;

a second coating station where a second side of the web is coated with a coat layer, said second coating station being downstream of said first non-contact dryer;

a third guide means for guiding the web to said second coating station;

a second non-contact dryer downstream of and above said second coating station for drying the coat lager applied to the web in said second coating station without contacting the web, said second non-contact driver comprising a second air dryer;

a fourth guide means for guiding the web from said second coating station upwards into said second non-contact dryer;

a second means for pulling the web from said second coating station through said second non-contact dryer, said second means for pulling the web from said second coating station through said second non-contact dryer comprises a group of drawing-in rolls furnished with a wire; and a second non-contacting guide means for guiding the web within and through said second non-contact dryer so that the web is first guided upward, then substantially horizontally in a machine direction, and then downward, said second non-contacting guide means comprising air jets.

18. An apparatus for coating a moving paper web, comprising:

a first coating station where a first side of the web is coated with a coat layer;

a first guide means for guiding the web to said first coating station;

a first non-contact dryer downstream of and above the first coating station for drying the coat layer applied to the web in said first coating station without contacting the web, said first non-contact dryer comprising a first air dryer;

a second guide means for guiding the web from said first coating station upwards into said first non-contact dryer;

a first means for pulling the web from said first coating station through said first non-contact dryer, said first means for pulling the web from said first coating station through said first non-contact dryer comprising a first group of drawing-in rolls furnished without a wire, said first group of drawing-in rolls being turned in a direction opposite to the machine direction;

a first non-contacting guide means for guiding the web within and through said first non-contact dryer, so that the web is first guided upward, then substantially horizontally in a machine direction, and then downward, said first non-contacting guide means comprising air jets;

a second coating station where a second side of the web is coated with a coat layer, said second coating station being downstream of said first non-contact dryer;

a third guide means for guiding the web to said second coating station;

a second non-contact dryer downstream of and above said second coating station for drying the coat layer applied to the web in said second coating station without contacting the web, said second non-contact dryer comprising a second air dryer;

a fourth guide means for guiding the web from said second coating station upwards into said second non-contact dryer;

a second means for pulling the web from said second coating station through said second non-contact dryer; and a second non-contacting guide means for guiding the web within and through said second non-contact dryer so that the web is first guided upward, then substantially horizontally in a machine direction, and then downward, said second non-contacting guide means comprising air jets.

19. The apparatus of claim 18, wherein said second means for pulling the web from said second coating station through said second non-contact dryer comprises a second group of drawing-in rolls furnished without a wire, said second group of drawing-in rolls being turned in a direction opposite to the machine direction.

20. A method for coating a moving paper web, comprising:

guiding a web to be coated to a first coater;

applying a coating layer to a first side of the web at the first coater;

guiding the web upward from the first coater into a first non-contact dryer;

drying the coating layer applied to the web in the first coater in the first non-contact dryer;

pulling the web from the first coater through the first non-contact dryer with a first group of drawing-in rolls furnished with a wire;

guiding the web non-contactingly with air jets within and through said first non-contact dryer so that the web is guided substantially horizontally in a machine direction, and then downward toward a level of a second coater;

guiding the web from the first non-contact dryer to the second coater;

applying a coating layer to a second side of the web at the second coater;

guiding the web upward from the second coater into a second non-contact dryer;

drying the coating layer applied to the web in the second coater in the second non-contact dryer; and pulling the web from the second coater through the second non-contact dryer.

21. The method of claim 20, further comprising spreading the web with a spreader roll after the web passes through the first non-contact dryer and after the web passes though the second non-contact dryer.

22. The method of claim 20, wherein the web is guided from the first non-contact dryer to the second coater by a roll.

23. The method of claim 22, further comprising spreading the web with a cambered air-turning device after the web passes through the first non-contact dryer and after the web passes though the second non-contact dryer.

24. The method of claim 20, further comprising applying another coating layer to each of the first and second sides of the web.

25. The method of claim 20, wherein drying the coating layers applied to the web is accomplished with a suspending air dryer and a turning device, wherein the turning device turns a direction of travel of the web using drying air jets.

26. The method of claim 25, wherein turning device emits a drying blast of air, and further comprising removing exhaust air of the dryers proximate the web on a side of the web where the turning device is located.

27. The method of claim 20, wherein the web is guided non-contactingly within and through said first non-contact dryer with air jets emitting air having a temperature greater than an ambient temperature.

28. The method of claim 27, wherein the temperature of the air emitted by said air jets non-contactingly guiding the web within and through said first non-contact dryer is from 80° C. to 300° C.

29. The method of claim 28, wherein the temperature of the air emitted by said air jets non-contactingly guiding the web within and through said first non-contact dryer is from 100° C. to 200° C.

30. The method of claim 20, wherein the web is pulled from the second coater through the second non-contact dryer with a second group of drawing-in rolls furnished with a wire.

31. An apparatus for coating a moving paper web, comprising:

a first coating station where a first side of the web is coated with a coat layer;

a first guide means for guiding the web to said first coating station;

a first non-contact dryer downstream of and above the first coating station for drying the coat layer applied to the web in said first coating station without contacting the web, said first non-contact dryer comprising a first air dryer;

a second guide means for guiding the web from said first coating station upwards into said first non-contact dryer;

a first means for pulling the web from said first coating station through said first non-contact dryer;

a first non-contacting guide means for guiding the web within and through said first non-contact dryer so that the web is first guided upward, then substantially horizontally in a machine direction, and then downward, said first non-contacting guide means comprising air jets;

a second coating station where a second side of the web is coated with a coat layer, said second coating station being downstream of said first non-contact dryer;

a third guide means for guiding the web to said second coating station;

a second non-contact dryer downstream of and above said second coating station for drying the coat layer applied to the web in said second coating station without contacting the web, said second non-contact dryer comprising a second air dryer;

a fourth guide means for guiding the web from said second coating station upwards into said second non-contact dryer;

a second means for pulling the web from said second coating station through said second non-contact dryer, second means for pulling the web from said second coating station through said second non-contact dryer comprising a group of drawing-in rolls furnished without a wire, said group of drawing-in rolls being turned in a direction opposite to the machine direction; and a second non-contacting guide means for guiding the web within and through said second non-contact dryer so that the web is first guided upward, then substantially horizontally in a machine direction, and then downward, said second non-contacting guide means comprising air jets.

32. A method for coating a moving paper web, comprising:

guiding a web to be coated to a first coater;

applying a coating layer to a first side of the web at the first coater;

guiding the web upward from the first coater into a first non-contact dryer;

drying the coating layer applied to the web in the first coater in the first non-contact dryer;

pulling the web from the first coater through the first non-contact dryer;

guiding the web non-contactingly with air jets within and through said first non-contact dryer so that the web is guided substantially horizontally in a machine direction, and then downward toward a level of a second coater;

guiding the web from the first non-contact dryer to the second coater;

applying a coating layer to a second side of the web at the second coater;

guiding the web upward from the second coater into a second non-contact dryer;

drying the coating layer applied to the web in the second coater in the second non-contact dryer; and pulling the web from the second coater through the second non-contact dryer with a group of drawing-in rolls furnished with a wire.

* * * * *